US007004749B2

(12) United States Patent
Asano et al.

(10) Patent No.: US 7,004,749 B2
(45) Date of Patent: Feb. 28, 2006

(54) COMBUSTION APPARATUS

(75) Inventors: Kimiaki Asano, Kobe (JP); Hitoshi Hara, Kobe (JP); Tetsurou Hamada, Kobe (JP); Toshihiro Hori, Kobe (JP); Hiroki Hasegawa, Kobe (JP)

(73) Assignee: Noritz Corporation, Hyogo (JP)

( * ) Notice: Subject to any disclaimer, the term of this patent is extended or adjusted under 35 U.S.C. 154(b) by 0 days.

(21) Appl. No.: 10/651,353

(22) Filed: Aug. 28, 2003

(65) Prior Publication Data

US 2004/0170937 A1 Sep. 2, 2004

(30) Foreign Application Priority Data

Aug. 29, 2002 (JP) ..... 2002-250546
Aug. 30, 2002 (JP) ..... 2002-255655

(51) Int. Cl.
*F23N 1/00* (2006.01)

(52) U.S. Cl. ..... 431/18; 431/90

(58) Field of Classification Search ..... 431/12, 431/18, 72, 73, 90
See application file for complete search history.

(56) References Cited

U.S. PATENT DOCUMENTS 3,592,574 A * 7/1971 Zenkner ..... 431/160
4,621,771 A * 11/1986 Chiba et al. ..... 239/585.4
6,581,573 B1 * 6/2003 Nimura et al. ..... 123/496
2004/0043342 A1 * 3/2004 Asano et al. ..... 431/1
2004/0126726 A1 * 7/2004 Hamada et al. ..... 431/208

FOREIGN PATENT DOCUMENTS

| | | | |
|---|---|---|---|
| JP | 58-140508 | | 8/1983 |
| JP | 60-022069 | | 2/1985 |
| JP | 62-186112 | | 8/1987 |
| JP | 63-275870 | | 11/1988 |
| JP | 01-167508 | | 7/1989 |
| JP | 02-057816 | | 2/1990 |
| JP | 02110210 A | * | 4/1990 |
| JP | 3-59310 | | 3/1991 |
| JP | 05-322153 | | 12/1993 |
| JP | 08-075141 | | 3/1996 |
| JP | 11-241808 | | 9/1999 |
| JP | 2000-161609 | | 6/2000 |
| JP | 2001-065813 | | 3/2001 |

* cited by examiner

*Primary Examiner*—Jiping Lu
(74) *Attorney, Agent, or Firm*—Wood, Phillips, Katz, Clark & Mortimer

(57) ABSTRACT

A combustion apparatus 2 has a fuel spraying nozzle 12, a feed canal 16 and a return canal 17, both the canals connected to the nozzle, with the former canal 16 feeding a fuel to the nozzle and with the later canal 17 allowing an unsprayed portion of the fuel to flow back. An electromagnetic pump 18 disposed in the feed canal 16 serves to compress the fuel towards the nozzle 12, and an injector valve 25 is disposed in the return canal 17. A low rate at which the fuel is sprayed out from the nozzle is controlled by a controlling means 40 by regulating the mode of opening and closing the valve body 33 of injector valve 25.

11 Claims, 5 Drawing Sheets

COMBUSTION APPARATUS

BACKGROUND OF THE INVENTION

1. Field of the Invention

The present invention relates to a combustion apparatus for burning a liquid fuel.

2. Description of Related Art

Some combustion apparatuses known in the art are of the type as disclosed in Patent Laying-Open Gazette No. 10-227453. A fuel spraying nozzle incorporated in this apparatus operates to blow a fuel mist to be burnt continuously. This nozzle is of the so-called return type that has an internal return path such that a portion of the fuel supplied from a fuel tank will flow back toward the tank through the internal return path and a return channel provided out of the nozzle.

FIG. 4 is a flow diagram showing the flow of fuel in the related art combustion apparatus that includes the return type nozzle. A fuel spraying nozzle 205 built in this apparatus 201 has a spray mouth for jetting a fuel mist. A fuel channel (or "a fuel canal") 209 connected to the nozzle 205 is composed of a feed channel (or "a feed canal") 210 reaching the spray mouth and a return channel (or "a return canal") 211 leading back therefrom to an upstream region of said channel. The feed channel 210 starting from a fuel tank 214 so as to terminate at an inlet of the spraying nozzle 205 does include electromagnetic valves 212 and 213 and an electromagnetic pump 215 that are arranged in series along the feed channel. On the other hand, the return channel 211 connected to a returning side of the nozzle 205 does include a check valve 216 and a proportional control valve 217, that are likewise arranged in series. A downstream end of the return channel 211 merges into the feed channel 210, at a junction intervening between the electromagnetic valve 212 and the electromagnetic pump 215.

The proportional control valve 217 disposed in the return channel 211 is the so-called "ball type" valve that cannot absolutely close this channel 211. Therefore, the one electromagnetic valve 212 is interposed between the junction and the fuel tank 214 so as to avoid any excessive or undesired flow of fuel from or towards this tank.

FIG. 5 shows the structure of proportional control valve 217 employed in the related art combustion apparatus 201. This valve has an internal fuel passage 221 formed in a casing 220 and extending between a fuel inlet end 222 and a fuel outlet end 223, with the inlet end 222 leading to the check valve 216. A valve seat 225 is formed at an intermediate point in the internal passage 221, and a spherical valve body 226 rests on this seat 225. A plunger 227 in contact with the valve body 226 is surrounded by an electromagnetic coil 228. With this coil being turned on with an electric current, it will make a stroke along the axis of casing so as to move the valve body 226 up and down.

As the plunger 227 displaces the valve body 226, the cross-sectional area of internal passage 221 will vary to change the flow rate of fuel advancing from the inlet end 222 to outlet end 223. A current regulator not shown but varying the intensity of electric power applied to the proportional control valve 217 will serve to control the fuel flow rate through the return channel.

The fuel stream effluent from the tank 214 will continuously be compressed in the electromagnetic pump 215, before entering the spraying nozzle 205.

The thus compressed fuel stream of a high pressure will reach the spray mouth that is located at a distal end of the spraying nozzle 205, so that a noticeable portion of such a fuel stream is blown outwards to form a mist. The remainder of said fuel stream will flow back from this nozzle 205, through the check valve 216 and into the inlet end 222 of proportional control valve 217. The remainder having entered this valve 217 through its inlet end 222 is delivered to an upstream region of the feed channel, at a flow rate determined by the intensity of current being applied to said coil 228.

Gradual change or certain fluctuation in the temperature of the proportional control valve 217 has been observed in the related art combustion apparatus 201 during its operation. Such a change or fluctuation as being caused by the change in ambient temperature and/or the like will in turn change the temperature of coil 228 installed in the casing 220. Electric resistance of the coil 228 will vary in response to the change in its temperature, thereby rendering unstable the current intensity applied to the coil 228. Consequently, the flow rate at which the remainder of fuel stream flows back through the return channel will become unreliable. It has been somewhat difficult for the related art apparatus 201 to precisely regulate the spraying rate of fuel, failing to stabilize the condition of combustion state.

Such an unstable combustion in the related art apparatus does mean that the amount of a fuel sprayed out of said nozzle would not be burnt completely. Incomplete combustion will result in the discharge of a non-burnt fraction, bringing about a poorer efficiency of energy. In addition, an unnegligible amount of toxic gasses such as carbon monoxide is likely to be discharged to the outside, and an undesirable accumulation of soot will take place inside the apparatus. Thus, the problem of environmental pollution has been inherent in the related art combustion apparatuses, not only rendering them likely to become out of order.

Further, the proportional control valve 217 incapable of absolutely close the channel in the related art apparatuses has necessitated the electromagnetic valve 212 to prevent a portion of the fuel fed back from escaping into or out of the tank 214. Such an extra valve has made complicated the related art apparatuses, raising manufacture cost and running cost thereof.

SUMMARY OF THE INVENTION

An object of the present invention made in view of the problems and drawbacks mentioned above is therefore to provide an advanced combustion apparatus that is simplified in structure, but is nevertheless possible to accurately regulate the sprayed rate of a fuel to ensure complete combustion.

In order to achieve this object, an aspect of a combustion apparatus provided herein comprises a spraying means for spraying a fuel, a feed channel (otherwise known as "a feed canal") for feeding the fuel to the spraying means, and a compressing means disposed in the feed channel so as to compress the fuel flowing towards the spraying means. The spraying means may be a return type nozzle, i.e., a nozzle having a spray mouth, an internal feed path and an internal return path. The combustion apparatus has to comprise further a return channel (otherwise known as "a return canal") connected to the spraying means so as to extend back to a junction where the return channel merges into the feed channel on an upstream side of the compressing means, such that a portion of the fuel once delivered to the spraying means through the feed channel will be allowed to flow back through the internal return path and the return channel into the junction. Still further, the apparatus has to comprise an intermittently operating valve disposed in the return channel so as to be closed and opened intermittently or periodically.

A valve body of the intermittently operating valve is to be driven to intermittently or periodically close or open the return channel, for the purpose of changing or varying a flow rate of the fuel. Instead of operating the proportional control valve to directly change the degree itself to which it is opened, the present apparatus can now be controlled to regulate an overall period in which this valve must be opened per unit time, or to regulate a frequency at which it must repeat to open. Such a mode of adjusting the spraying rate of fuel will not be adversely affected by any change in ambient temperature or the like, thus avoiding any fluctuation or variation in the spraying rate that would otherwise make it difficult to ensure stable combustion.

ON-OFF motions of the valve body of the intermittently operating valve will be effective to change a fuel flow rate through the return channel, thereby adjusting another flow rate of the fuel to be sprayed. The amount of returning fuel that will flow back during each period of the opened state of valve body is not affected by any change in ambient temperature or the temperature of this valve, but does stand almost constant.

Accurate amount of fuel can now be sprayed and burnt to ensure complete combustion at an improved efficiency of energy, supplying any desired amount of heat.

Stable combustion now afforded herein will minimize the amount of toxic gases such as carbon monoxide and the amount of soot likely to be produced during a combustion process. The apparatus is favorable from a viewpoint of protecting environment from pollution and also protecting the apparatus itself from any damage.

The intermittently operating valve may comprise a throttling valve body that will also close and open the return channel to regulate the flow rate of fuel.

Also in this case, an accurate amount of fuel can be sprayed and burnt to ensure complete combustion at an improved efficiency of energy, without being affected by any change in ambient temperature but supplying any desired amount of heat.

The intermittently operating valve may comprise an actuator, a drive for driving the actuator and a valve body movable in unison with the actuator. So long as the drive remains off not receiving any electric current, the valve body stands closing the return channel, but it will be moved by the actuator so as to open the channel when the drive is electrically activated.

In this case, the valve body of intermittently operating valve will not change its opened degree in response to a change in electric current, but open or close the channel fully depending on whether the actuator is electrically energized or not. Any change in ambient temperature will not adversely affect the accuracy of spraying rate.

Accurate amount of fuel can now be sprayed to stabilize the condition of combustion, without involving any surplus or deficiency in the fuel flow rate, and affording an improved efficiency of energy to supply any desired amount of heat. Such a stable combustion will remarkably diminish the amount of carbon monoxide and soot.

The intermittently operating valve may be an injector valve comprising a throttling valve body that will also close and open the return channel to regulate the flow rate of fuel.

The "injector valve" employed in this case will rapidly repeat to move the valve body so as to open and close the return passage within a very short period of time. Such an "injector valve" may be composed of an actuator, an electromagnetic coil for driving the actuator and a valve body movable in unison with the actuator. The valve body will open the channel when the electromagnetic coil is electrically energized.

The ON-OFF motions of the valve body of the injector valve will be effective to change a fuel flow rate through the return channel, thereby adjusting another flow rate of the fuel to be sprayed. The amount of returning fuel that will flow back during each period of the opened state of valve body is not affected by any change in ambient temperature or the temperature of this valve, but does stand almost constant. Thus, an accurate amount of fuel can now be sprayed and burnt to ensure complete combustion at an improved efficiency of energy, supplying any desired amount of heat.

Stable combustion now afforded herein will minimize the amount of toxic gases such as carbon monoxide and the amount of soot likely to be produced during a combustion process. The apparatus is favorable from a viewpoint of protecting environment from pollution and also protecting the apparatus itself from any damage.

However, very rapid, sharp and frequent motions of the intermittently operating valve for regulating the fuel flow rate may be prone to cause vibration, more or less and strong or weak. This valve is connected to the feed and return channels, directly or indirectly, so that such a vibration produced by the valve will possibly be transmitted through these channels to the spraying means, adversely affecting the state of combustion.

Taking into account such a possible problem, at least one of the feed and return channels connected to the spraying means has at least one bend located between its ends. Preferably each of the channels bends angularly several times. The channels may each curve several times or may each have at least one corrugated or spiral portion.

Even if any vibration is generated by the valve intermittently operating and connected to those channels to regulate the fuel flow rate, the vibration will be attenuated by and in the at least one bend. Such a vibration not transmitted to any other part of this combustion apparatus will not give rise to any incomplete combustion or any noise, thus assuring stable operation of the apparatus.

The compressing means may be an electro-magnetic pump driven with an alternating current from a power source.

The apparatus may further comprise a combustion chamber with increased diameter in a direction towards downstream of the sprayed mist of fuel. The diameter may increase stepwise or may be tapered to increase towards the downstream.

The liquid fuel will be jetted from the pointed spraying means in a flared pattern gradually increasing its diameter as the sprayed mist advances away from said means. There may be some undesirable hypothetical cases wherein some portions of the jetted mist stick to the wall of a combustion chamber and/or the internal temperature thereof is considerably low, so that many mist particles would tend to aggregate not to be burnt smoothly. For example, a parallelepiped space including some dead zones that would not be heated enough to combustion of the fuel mist is not recommended as the combustion chamber. Further, the chamber must not have any wall portions allowing those mist particles to adhere thereto, so that some portion of the liquid fuel should not be lost without being burnt.

In view of these possible problems, the combustion chamber proposed herein has diameter that is increased towards the downstream zone in harmony with the shape of a sprayed mist stream. This structure will be useful to completely burn the fuel jetted from the nozzle, without causing any portion of the fuel to stick to the wall of combustion chamber.

A clearance appearing during combustion and between the periphery of flame formed herein and the inner wall surface of he combustion chamber flaring as above is so small that combustion heat will be spread uniformly throughout the interior of said chamber. There will be no significant variance in temperature within said interior, whereby all the portions of a liquid fuel ejected in various directions will be burnt completely, without suffering from the problem of aggregation.

The apparatus may further comprise a combustion chamber with increased diameter in a direction towards down-stream of the sprayed mist of fuel. The chamber has a peripheral wall that is perforated to have many small air holes keeping the chamber's interior in fluid communication with the chamber's exterior.

Also in this case, the combustion chamber flares towards the down-stream zone so that the jetted fuel will completely be burnt, without any portion thereof sticking to the wall of combustion chamber.

A clearance appearing during combustion and between the periphery of flame formed herein and the inner wall surface of combustion chamber flaring as above is so small that no aggregation of fuel particles will take place. In addition, the small holes formed in and through the peripheral wall of the combustion chamber do serve to positively take in the ambient fresh air. This air will be intermixed well with the fuel mist or flame within the chamber, thereby facilitating complete combustion.

Also in order to achieve the object mentioned above, another aspect of a combustion apparatus provided herein comprises, a spraying means for spraying a fuel, a feed channel for feeding the fuel to the spraying means, and a compressing means disposed in the feed channel so as to compress the fuel flowing towards the spraying means. The spraying means may be a return type nozzle, i.e., a nozzle having a spray mouth, an internal feed path and an internal return path. The apparatus may further comprise a return channel connected to the spraying means so as to extend back to a junction where the return channel merges into the feed channel on an upstream side of the compressing means, such that a portion of the fuel once delivered to the spraying means through the feed channel will be allowed to flow back through the return channel into the junction. Still further, the apparatus may comprise an intermittently operating valve disposed in the return channel so as to close and open the return channel intermittently or periodically to thereby regulate a flow rate of fuel, in addition to a feed channel checking means disposed in the feed channel and on a downstream side of said compressing means. The checking means will normally prevent the fuel from flowing backwards but will be opened to allow the fuel to flow forwardly towards the spraying means, when a pressure at a predetermined level acts on this checking means.

A valve body of the intermittently operating valve is to be driven to intermittently or periodically close or open the channel, for the purpose of changing or varying a flow rate of the fuel. The present apparatus can now be controlled to regulate an overall period in which this valve must be opened per unit time, or to regulate a frequency at which it must repeat to open. Such a mode of adjusting the spraying rate of fuel will not be adversely affected by any disturbance such as change in ambient temperature, thus avoiding any fluctuation or variation in the spraying rate that would other-wise make it difficult to ensure complete combustion.

The intermittently opening valve employed herein is capable of perfectly stopping the back flow of fuel (towards the spraying means) in the return channel, so that return flow can now be adjusted highly accurately, thus adequately regulating the fuel spraying rate.

Further, the feed channel checking means disposed down-streamly of the compressing means will normally prevent the fuel from flowing forwards, until opened due to a given pressure which the compressing means generates and applies to this checking means. Thus, both the feed and return channels will be closed properly and temporarily to prevent leakage of fuel out of this system.

Instead of operating the proportional control valve to directly change an opened cross-sectional area, the present apparatus can now be controlled to regulate the fuel flow rate by intermittently or periodically opening the valve in the return channel. Such a mode of adjusting the spraying rate of fuel will not be adversely affected by any change in ambient temperature or the like, thus enabling the spraying of an desired accurate amount of fuel to be combusted.

Thus, the sprayed fuel will now be burnt completely to improve energy efficiency as compared with the related art apparatuses.

Proper adjustment of the spraying rate of fuel will enable a precise control of the ratio of amount of fuel to the amount of air intermixed there-with, thus affording stable combustion of fuel. Stable combustion will in turn minimize the amount of toxic gases such as carbon nonoxide and the amount of soot likely to be produced during a combustion process. The apparatus is favorable from a viewpoint of protecting environment from pollution and also protecting the apparatus itself from any damage.

The feed channel checking means is normally closed but capable of opening due to a predetermined pressure that is higher than a hydrostatic pressure head of the fuel then present in the fuel tank that is connected to the feed channel.

Thus, such a hydrostatic head lower than the predetermined pressure is insufficient to open the normally closed checking means. This means that the checking means is useful to prevent leakage of fuel, because in inoperative state of the apparatus the spraying means will not receive any amount of fuel. If and when the fuel has to be fed from the tank and sprayed, the compressing means will operate to produce the predetermined pressure or a higher pressure to open the checking valve and to feed the fuel to the spraying means.

The apparatus may further comprise a return channel checking means disposed in the return channel but upstreamly of the intermittently operating valve (thus between this valve and the spraying means). The checking means will normally allow the fuel to flow towards the valve, while preventing it from flowing in a reversed direction.

The return channel checking means cooperates with the intermittently operating valve so as to more surely close the return channel against such a reversed flow of fuel. Fuel flow through the return channel will be more accurately controlled, thanks to this structure.

The apparatus may further comprise a feed channel closing means disposed in the feed channel and between the compressing means and the feed channel checking means.

The feed channel closing means cooperates with the feed channel checking means so as to more surely close the feed channel against such a forward but undesired flow of fuel, thereby more surely preventing leakage of fuel.

The apparatus may further comprise an accumulator disposed in the return channel and between the return channel checking means and the intermittently operating valve.

In this case, the return channel will be closed tightly and temporarily between the return channel checking means and the intermittently operating valve, thus tending to raise the fuel pressure in this region. In this event, an extra-ordinarily strong stress would be imparted to these means and valve and impair their durability. However, the accumulator employed herein will buffer such an extreme pressure so as to protect them from breakage or damage, thereby enhancing their durability.

It is a further advantage of the apparatus in this case that the accumulator will precisely control and stabilize the spraying rate of fuel thus stabilizing the flame, facilitating complete and efficient combustion and also reducing combustion noise.

The intermittently operating valve may be an injector valve comprising a throttling valve body that will also close and open the return channel to regulate the flow rate of fuel.

This valve body is to be driven to intermittently or periodically close or open the return channel, for the purpose of changing or varying a flow rate of the fuel. Instead of operating the proportional control valve to directly change the degree itself to which it is opened, the frequency at which the valve body repeats to close and open the passage will now be adjusted to control the fuel flow rate. Such a mode of control will not be adversely affected by any change in ambient temperature or the like, thus avoiding any fluctuation or variation in the spraying rate and combustion rate that would otherwise make it difficult to ensure stable combustion.

Stable combustion now afforded herein will minimize the amount of toxic gases such as carbon monoxide and the amount of soot likely to be produced during a combustion process. The apparatus is favorable from a viewpoint of protecting environment from pollution and also protecting the apparatus itself from any damage.

THE PREFERRED EMBODIMENTS

Figure 1:
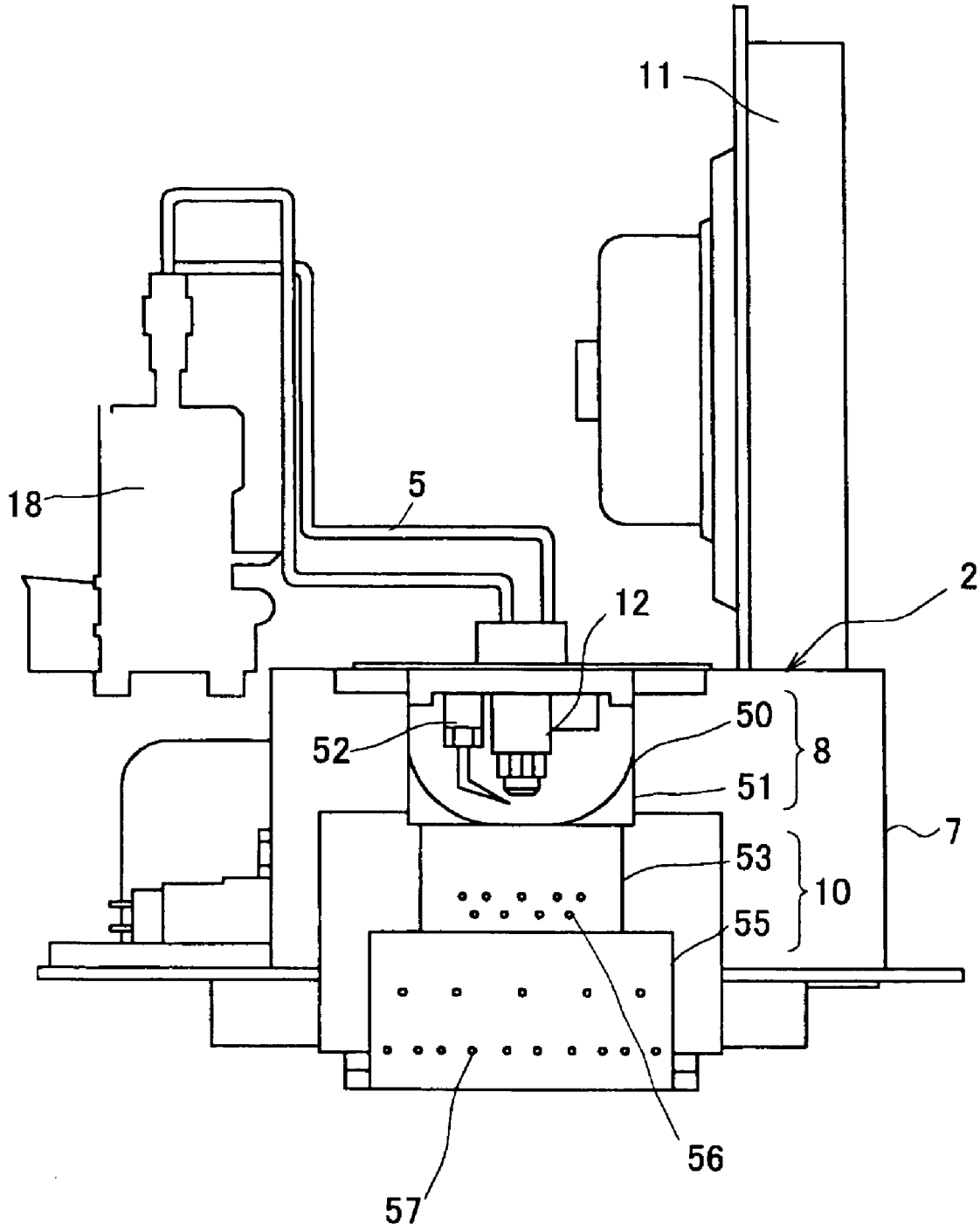
FIG. 1 is a schematic front elevation of a combustion apparatus provided in an embodiment of the present invention.

In FIG. 1, a combustion apparatus of a first embodiment is generally denoted at the reference numeral 2. This apparatus 2 comprises a nozzle block 8 having an end opened in a hollow shell 7, and a combustion chamber 10 is attached to the end of nozzle block 8. A fan or blower 11 mounted on the shell 7 will operate to feed the ambient air into the combustion chamber 10. A fuel spraying nozzle (as the spraying means) 12 is installed in the nozzle block 8 in order to spray a fuel towards and into the combustion chamber 10.

The spraying nozzle 12 has a spray mouth (not shown) for jetting the fuel. An internal feed path (not shown) and an internal return path (not shown) leading to or starting back from the spray mouth are formed in or for the nozzle 12. Thus, the fuel spraying nozzle 12 will operate to jet a portion of the fuel that is being fed from the outside though the feed canal. The remainder of said fuel will be left unsprayed to subsequently flow back through the return canal.

Figure 2:
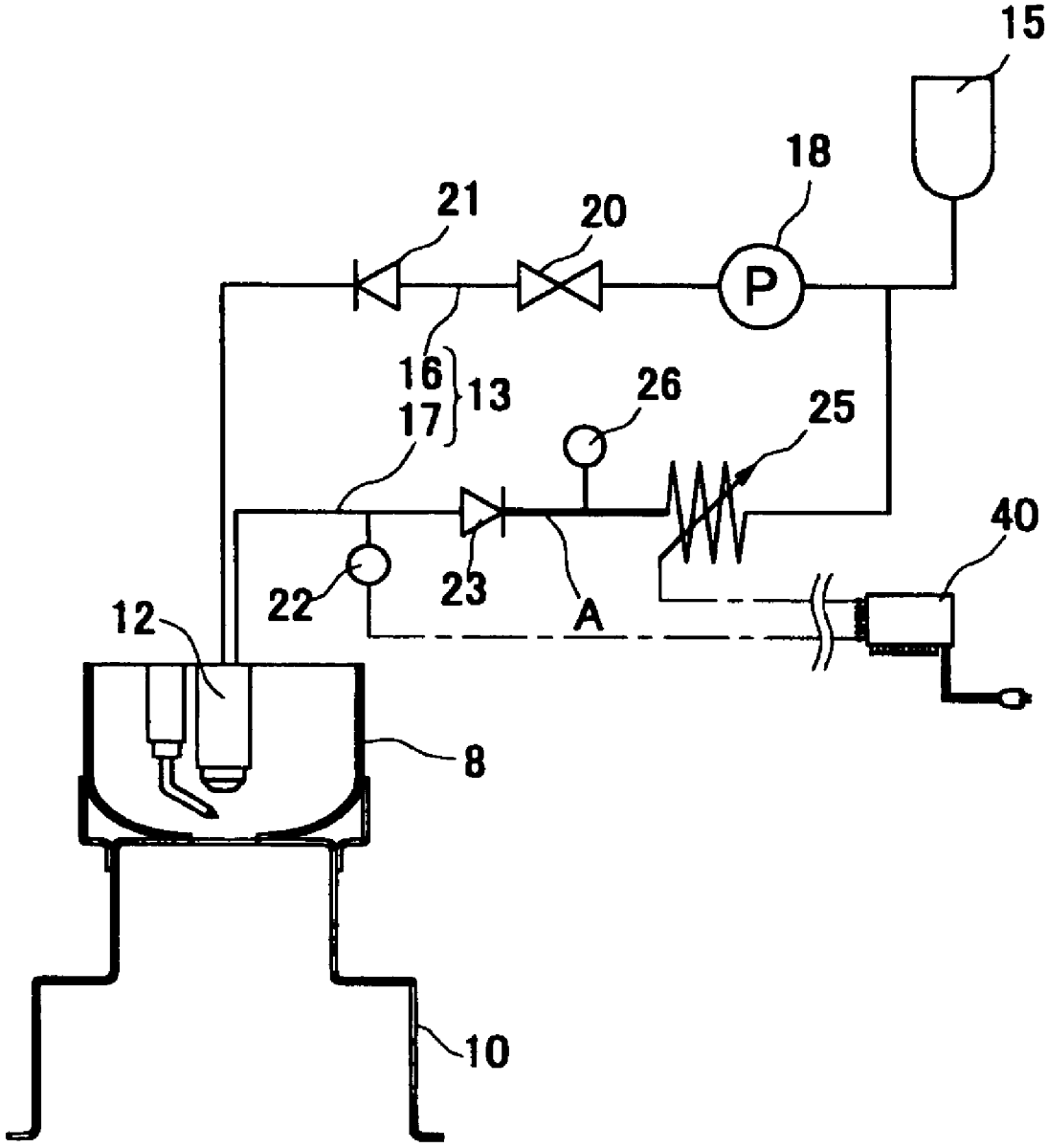
FIG. 2 is a diagram showing a fuel pipe line that is constructed in the apparatus shown in FIG. 1.

As seen in FIG. 2, a fuel pipe line 13 connects the fuel spraying nozzle 12 to a fuel tank 15 holding therein a mass of the fuel The pipe line 13 consists mainly of a fuel feed canal (i.e., a feed channel) 16 and a return canal (i.e., a return channel) 17, such that the former canal communicates with an internal feed path formed in the nozzle 12 and the latter canal 17 communicates with an internal return path also formed in the spraying nozzle 12. As shown in FIG. 1, pipes 5 forming those feed and return canals 16 and 17 extend outwardly of the shell 7 so as to lead to an injector valve 25 and an electromagnetic pump 18, that are detailed below. Those pipes 5 also connected to the nozzle 12 are each bent several times at substantially right angles between the nozzle and the valve 25 or pump 18. Bends formed thus in said pipes will make same more tenacious on one hand, and will attenuate any vibration being transmitted from said pump 18 or injector valve 25 on the other hand. Thus, such a vibration will scarcely reach the spraying nozzle 12, thereby protecting it from damage.

The feed canal 16 combining the nozzle 12 with the fuel tank 15 in series does serve to supply the nozzle with the fuel stored in the tank. Disposed in this canal 16 are the electromagnetic pump 18, an electromagnetic valve 20 and a check valve (as a feed channel checking means) 21. The check valve 21 normally stands closed, and an activation pressure (that is a minimum actuating pressure) for opening this valve is higher than a maximum hydrostatic head of the fuel in tank 15 standing in fluid communication with the feed canal 16. In other words, the hydrostatic pressure caused by the fuel stored in the tank 15 will never exceed the minimum pressure for activating the checking valve 21 to open. For example, in the combustion apparatus 2 of the present embodiment, the fuel tank 15 is disposed higher than the valve 21 by 0.5 meter. The minimum actuating pressure is 0.2 $Kgf/cm^2$ (viz., $2.0\times10^4$ Pa) for this valve 21, that is much higher than the hydrostatic head 0.04 $Kgf/cm^2$ (viz., $0.39\times10^4$ Pa) for the fuel in tank 15. Thus, the fuel will not flow toward the spraying nozzle 12 unless the pump 18 compresses it. Although the minimum actuating pressure for said valve 21 is selected herein to be high by about 5 times of said hydrostatic head of said fuel, the ratio of the former to the latter may fall within a range from 3 to 5.

The fuel tank 15 may alternatively be positioned at any height, from 1.5 m above to 2.0 m below the valve 21, thus making the hydrostatic head not higher than 0.12 $Kgf/cm^2$ (viz., $1.2\times10^4$ Pa).

As noted above, the normally closed check valve 21 shall not naturally open merely due to hydrostatic head of the fuel in tank 15. There may be a possibility that the electromagnetic valve 20 would unintentionally open, though fuel feed to the nozzle 12 had to be interrupted for the combustion apparatus 2 then standing inoperative. Even in such an accident, the check valve 21 will surely stop the fuel not to leak out towards a downstream canal region. If and when the fuel from the tank 15 has to be sprayed, it will be compressed by the pump 18 and enabled to pass through the valve 21 and flow to the nozzle 12.

A portion of the fuel fed to the nozzle 12 will be left there unburnt, and such a remainder will flow back towards the tank 15 through the return canal 17. A downstream end (near the tank 15) of the return canal 17 merges into the feed canal 16 at its intermediate point located on the up-stream side of electromagnetic pump 18 (and facing the tank 15). Disposed at another intermediate point of the return canal 17 is a temperature sensor (viz., temperature sensing means) 22 for detecting the temperature of fuel flowing back through this canal. A further check valve (as the return channel checking means) 23 is disposed downstreamly of the sensor 22 so that the fuel can flow towards the tank 15 but is inhibited from flowing in a reversed direction away from this tank. Disposed on the downstream side of the check valve 23 is the injector valve (viz., intermittently operating valve) 25 that will be opened and closed periodically at given time intervals. An accumulator 26 intervening between the injector valve 25 and the further check valve 23 will serve to buffer fluctuation in pressure of the fuel flowing through the return canal 17.

Figure 3:
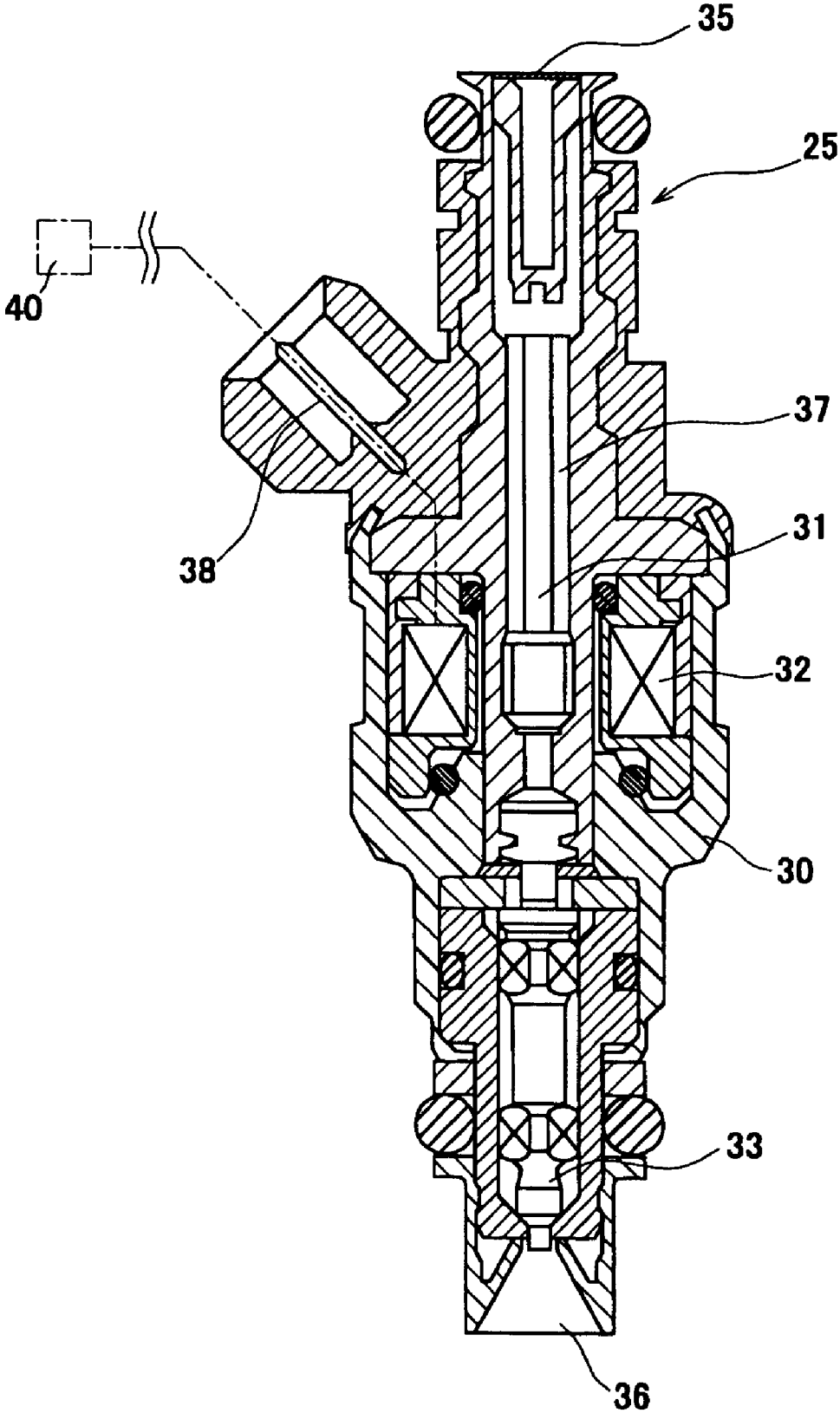
FIG. 3 is a cross section of an injector valve incorporated in the apparatus of FIG. 1.
Figure 4:
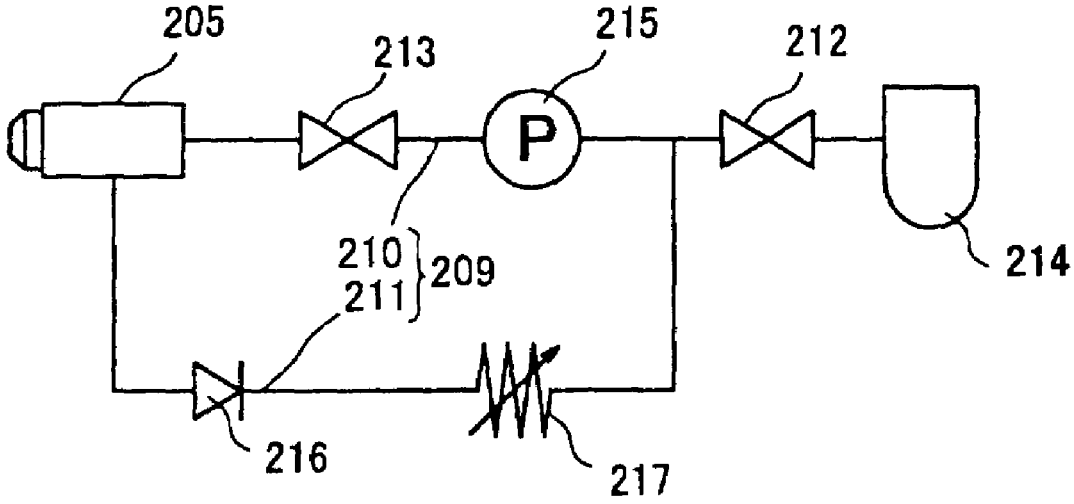
Fig. 4 (Prior Art)
FIG. 4 is a diagram showing a fuel pipe line in the related art combustion apparatus.
Figure 5:
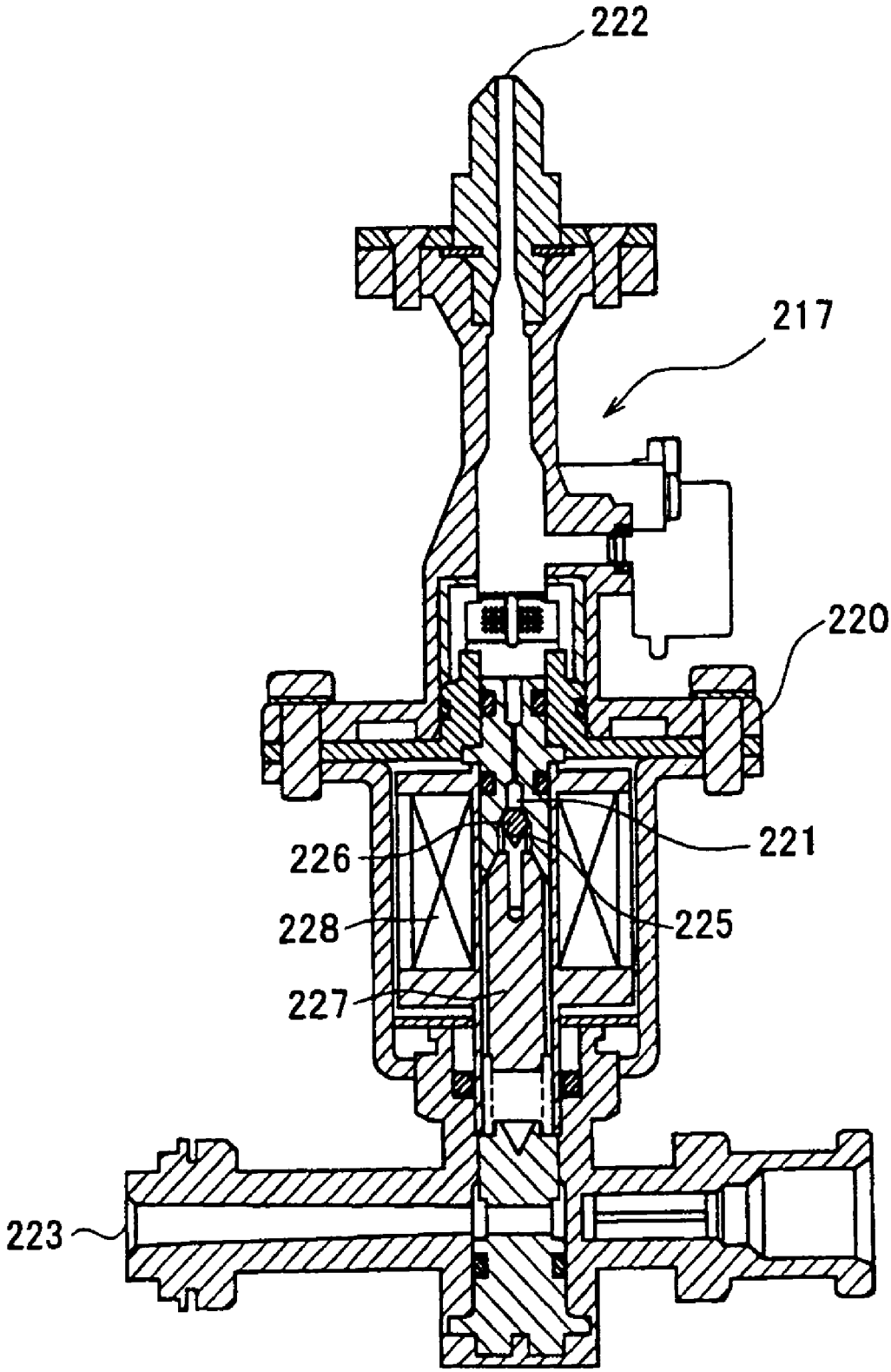
Fig. 5 (Prior Art)
FIG. 5 is a cross section of a proportional control valve employed in the related art apparatus.

The injector valve 25 will operate at an extreme high frequency to be opened and then instantly closed. As shown in FIG. 3, this valve 25 comprises a casing 30, an actuator 31 held therein, an electromagnetic coil 32 for driving the actuator 31, and a valve body 33 movable in unison with the actuator 31. Formed at opposite ends of the casing 30 are a fuel inlet 35 and a fuel outlet 36, with an internal fuel passage 37 extending between them 35 and 36 and through the casing 30.

The casing 30 has a terminal 38 leading to the electromagnetic coil 32 so that power supply through this terminal 38 will activate said coil 32. Consequently, the actuator 31 will be energized within the casing 30, thereby simultaneously driving the valve body 33 to open the passage 37 that is a part of the return canal 17. The valve body 33 of the present embodiment thus opens the passage 37 instantly in response to the coil 32 energized with an electric current, and said body 33 will close the passage instantly upon inactivation of said coil 32. The injector valve 25 in such a closed state in response to inactivated coil 32 will have its valve body 33 very tightly shutting the fuel passage 37 to absolutely close the return canal 17.

The terminal 38 is connected to a controlling means 40 that is incorporated to regulate the spraying rate of fuel jetting from the nozzle 12 and also to regulate the operation of fan or blower 11. The controlling means 40 is designed to periodically or intermittently activate the coil 32 to displace the valve body 33 to open and to close the passage, thus controlling the flow rate of fuel being sprayed from the nozzle 12.

For example, the control means 40 may perform a duty ratio control with respect to one-cycle time 'L' in which the valve body 33 opens and closes the passage one time and at the same time with respect to an overall time 't' in which the valve is open during the one cycle time 'L'. In detail, duty ratio 'r' may be the ratio of 'L' to 't', in which time 't' a pulse current will be applied to the coil 32 for the nozzle 12. Flow rate of the fuel flowing back through the return canal 17 is controlled accurately in this manner so as to indirectly but precisely adjust the flow rate of fuel actually jetted from the spraying nozzle 12.

It is noted here that the electromagnetic pump 18 always imparts a constant discharge pressure to a fuel flow that is being urged by this pump towards the nozzle 12 in this apparatus 2. Any change in the flow rate of the fuel being discharged from said pump will never affect the constant discharge pressure. Thus, the valve body 33 of injector valve 25 is always subjected to a constant pressure.

The valve body 33 will open the passage in response to a pulse current input to the terminal 38. A portion of fuel is thus blown back from the outlet of injector valve 25 at a constant return pressure, that is ensured by virtue of the constant discharge pressure of said pump. The amount of fuel having returned back through the injector valve 25 in a given period of time does depend on an overall time in which the valve body 33 has been open during this period. Thus a constant amount of fuel per unit time flows through the valve at a constant pressure when the pulse current applied to the terminal 38 is "ON". Thus, the amount of fuel that will have passed the injector valve 25 can be regulated by means of the time period in which the valve body 33 will be kept open during this time period. Thus, the flow rate of fuel flowing back into and passing through the return canal 17 will be adjusted to realize a desired flow rate of said fuel to be burnt at the spraying nozzle 12. The duty ratio 'r' measured in this way may be used in the duty ratio control executed in the controlling means 40.

So long as the apparatus is inoperative not to conduct combustion process, the controlling means 40 will interrupt the current to the coil 32, thus tightly closing the injector valve 25. The return canal 17 is thus closed at the two checkpoints, that is, the check valve 23 and injector valve 25.

As mentioned above and shown in FIG. 1, the spraying nozzle 12 is installed in the nozzle block 8. This block is a double cylinder composed of an inner cylinder 50 surrounding the nozzle and an outer cylinder 51 en-closing said inner cylinder.

The inner cylinder 50 covers the spraying nozzle 12 and an ignition plug 52 for inflammation of the fuel mist jetted from the nozzle. The combustion chamber 10 secured to such a nozzle block 8 is formed integral therewith. An air intake (not shown) disposed beside the inner and outer cylinders 50 and 51 will feed ambient air into the chamber 10 to be consumed in the combustion process.

The combustion chamber 10 is of a stepped shape as seen in FIG. 1 such that its first cylinder 53 fixed on the nozzle block 8 continues to a second cylinder 54. The second cylinder 54 has a diameter larger than that of the first one 53, thereby increasing stepwise the diameter of combustion chamber 10 towards its distal end remote from the nozzle 12.

The first cylinder 53 continuing from the nozzle block 8 has a perforated peripheral wall to have a multiplicity of air holes 56 arranged all around this cylinder, whereby ambient air will penetrate this cylinder to flow into the combustion cylinder 10.

Likewise, the second cylinder 55 continuing from the first one 53 has a perforated peripheral wall to have a multiplicity of further air holes 57 also arranged all around this cylinder, whereby a further amount of ambient air will penetrate this cylinder to flow into the combustion camber 10.

The combustion chamber 10 thus increasing diameter towards its distal end is shaped in conformity with configuration of the stream of mist sprayed from nozzle 12. No noticeable quantity of fuel will not adhere to the inner surface of combustion chamber 10, and no remarkable gap will appear between this surface and the periphery of a flame produced during the combustion process.

The fuel being sprayed from the nozzle 12 will thus spread evenly throughout the combustion chamber 10, whereby combustion heat will be distributed to the chamber's wall and the interior of chamber also uniformly. Temperature distribution throughout this chamber 10 is now rendered so uniform that almost all the fuel particles sprayed from nozzle 12 will be completely burnt, without suffering from aggregation of them.

As noted above, the gap between the combustion chamber wall 10 and the flame is reduced and a sufficient amount of ambient air is introduced into the chamber through the air holes 56 and 57. Thanks to these structural features, the fuel sprayed into and flaming in said chamber is intermixed well with the ambient air so as to ensure complete combustion.

As also noted above, both the feed canal 16 to and the return canal from the spraying nozzle 12 are capable of being shut with two valves, that is, valves 20 and 21 or valves 23 and 25. Thus, the fuel tank 15 can be sealed tightly against these canals, whenever so required.

An inter-valve zone 'A' present between injector valve 25 and check valve 23 may tend to show a high pressure to injure either of these valves, because of a tightly closing nature of the injector valve 25. However, the accumulator 26 disposed in the return canal 17 and absorbing such a high internal pressure will effectively protect them from damage.

The related art fuel pipe line 209 in a combustion apparatus necessitates two or more electromagnetic valves, but they are usually expensive, bulky and cause waste of electric energy. In contrast, the fuel pipe line 13 forming the combustion apparatus 2 of the invention has only one electromagnetic valve 20 installed therein in combination of two check valves 21 and 23 and one injector valve 25. Thus, the present apparatus is rendered more compacted and capable of being manufactured inexpensively and operating with a reduced consumption of electric power, thus resolving all the drawbacks inherent in the related art apparatuses.

As the electromagnetic pump in the feed canal 16 discharges fuel in constant pressure, flow rate of fuel supplied to the spraying nozzle is quite constant. The injector valve 25 employed herein and disposed in return canal 17 does cooperate with the single electromagnetic valve 20 of feed canal, in a very preferable manner. The opening and dosing of the former valve 25 is repeated fast and frequently at every instant, with the latter valve 20 constantly discharging the fuel, so that it will be sprayed at any accurate and desired rate from the spraying nozzle 12 into the combustion chamber 10 in a highly stable fashion. Thus, the fuel well mixed with ambient air within this chamber will exactly and efficiently produce a required amount of heat, without giving rise to any material loss of the fuel fed to the nozzle.

Stable and complete combustion of fuel in the apparatus 2 will minimize the amount of carbon monoxide or the like toxic gases and soot which incomplete combustion has been producing, thereby diminishing environ-mental pollution and breakdown of apparatus.

What is claimed is:

1. A combustion apparatus comprising:

a spraying means for spraying a fuel, a feed channel for feeding the fuel to the spraying means, a compressing means disposed in the feed channel so as to compress the fuel flowing towards the spraying means, the spraying means being a nozzle having a spray mouth, an internal feed path and an internal return path, a valve in the feed channel through which fuel is discharged towards the spraying means, a return channel connected to the spraying means so as to extend back to a junction where the return channel merges into the feed channel on an upstream side of the compressing means, and an intermittently operating valve disposed in the return channel so as to be closed and opened intermittently or periodically, so that a portion of the fuel once delivered to the spraying means through the feed channel is allowed to flow back through the internal return path and the return channel into the junction, wherein the intermittently operating valve is an injector valve comprising a throttling valve body capable of closing and opening the return channel to regulate a flow rate of the fuel, the intermittently operating valve cooperating with the valve in the feed channel to control spraying of fuel into the combustion chamber at a desired rate.

2. A combustion apparatus as defined in claim 1, wherein the intermittently operating valve comprises an actuator and a drive for driving the actuator, and the valve body is movable in unison with the actuator, such that so long as the drive remains off not receiving any electric current, the valve body stands closing the return channel, but capable of being moved by the actuator so as to open the return channel when the drive is electrically activated.

3. A combustion apparatus as defined in claim 1, wherein at least one of the feed and return channels connected to the spraying means has at least one bend located between its ends.

4. A combustion apparatus as defined in claim 1, wherein the compressing means is an electromagnetic pump driven with an alternating current.

5. A combustion apparatus as defined in claim 1, further comprising a combustion chamber with increased diameter in a direction towards downstream of a sprayed mist of the fuel.

6. A combustion apparatus as defined in claim 1, further comprising a combustion chamber with increased diameter in a direction towards downstream of a sprayed mist of the fuel, wherein the chamber has a peripheral wall that is perforated to have a plurality of air holes keeping the chamber's interior in fluid communication with the chamber's exterior.

7. A combustion apparatus comprising:

a spraying means for spraying a fuel, a feed channel for feeding the fuel to the spraying means, a compressing means disposed in the feed channel so as to compress the fuel flowing towards the spraying means, a valve in the feed channel through which fuel is discharged towards the spraying means, the spraying means being a nozzle having a spray mouth, an internal feed path and an internal return path, a return channel connected to the spraying means so as to extend back to a junction where the return channel merges into the feed channel on an upstream side of the compressing means, such that a portion of the fuel once delivered to the spraying means through the feed channel flows back through the return channel into the junction, an intermittently operating valve disposed in the return channel so as to close and open the return channel intermittently or periodically to regulate a flow rate of the fuel, and a feed channel checking means disposed in the feed channel and on a downstream side of the compressing means, so that the fuel is normally prevented from flowing backwards by the checking means that is capable of opening to allow the fuel to flow forwardly towards the spraying means when a pressure at a predetermined level acts on the checking means, wherein the intermittently operating valve is an injector valve comprising a throttling valve body closing and opening the return channel to regulate the flow rate, the intermittently operating valve cooperating with the valve in the feed channel to control spraying of fuel into the combustion chamber at a desired rate.

8. A combustion apparatus as defined in claim 7, further comprising a fuel tank, wherein the feed channel checking means is normally closed but capable of opening due to a predetermined pressure that is higher than a hydrostatic pressure head of the fuel then present in the fuel tank that is connected to the feed channel.

9. A combustion apparatus as defined in claim 7, further comprising a return channel checking means disposed in the return channel but upstreamly of the intermittently operating valve so that the return channel checking means normally allows the fuel to flow towards the valve, while preventing it from flowing in a reversed direction.

10. A combustion apparatus as defined in claim 7, further comprising a feed channel closing means disposed in the feed channel and between the compressing means and the feed channel checking means.

11. A combustion apparatus as defined in claim 7, further comprising an accumulator and a return channel checking means, the accumulator being disposed in the return channel and between the return channel checking means and the intermittently operating valve.

* * * * *